US008307946B1

(12) United States Patent
Johnston

(10) Patent No.: US 8,307,946 B1
(45) Date of Patent: Nov. 13, 2012

(54) FIREARM SUPPRESSOR WITH MULTIPLE GAS FLOW PATHS

(76) Inventor: Cory L. Johnston, Sioux Falls, SD (US)

( * ) Notice: Subject to any disclaimer, the term of this patent is extended or adjusted under 35 U.S.C. 154(b) by 0 days.

(21) Appl. No.: 13/155,563

(22) Filed: Jun. 8, 2011

(51) Int. Cl.
*F41A 21/00* (2006.01)

(52) U.S. Cl. ..... 181/223; 89/14.3; 89/14.4

(58) Field of Classification Search ..... 181/223; 89/14.3, 14.4
See application file for complete search history.

(56) References Cited

U.S. PATENT DOCUMENTS

| | | | | |
|---|---|---|---|---|
| 4,588,043 | A * | 5/1986 | Finn | 181/223 |
| 4,907,488 | A | 3/1990 | Seberger | |
| 4,939,977 | A | 7/1990 | Stroup | |
| 4,974,489 | A * | 12/1990 | Fishbaugh | 89/14.4 |
| 5,164,535 | A | 11/1992 | Leasure | |
| 6,079,311 | A | 6/2000 | O'Quinn | |
| D435,623 | S * | 12/2000 | Andrews et al. | D22/108 |
| 6,302,009 | B1 * | 10/2001 | O'Quinn et al. | 89/14.4 |
| 6,308,609 | B1 * | 10/2001 | Davies | 89/14.4 |
| 6,425,310 | B1 * | 7/2002 | Champion | 89/14.3 |
| 6,575,074 | B1 * | 6/2003 | Gaddini | 89/14.4 |
| 6,899,008 | B2 * | 5/2005 | Breuer | 89/14.3 |
| 7,237,467 | B1 | 7/2007 | Melton | |
| 7,587,969 | B2 * | 9/2009 | Silvers | 89/14.4 |
| 7,600,461 | B1 * | 10/2009 | Cler et al. | 89/14.3 |
| 7,856,914 | B2 * | 12/2010 | Shults et al. | 89/14.4 |
| 7,931,118 | B1 * | 4/2011 | Cronhelm | 181/223 |
| 8,087,338 | B1 * | 1/2012 | Hines | 89/14.4 |
| 8,096,222 | B2 * | 1/2012 | Silvers | 89/14.4 |
| 8,100,224 | B1 * | 1/2012 | Olson | 181/223 |
| 8,104,570 | B2 * | 1/2012 | Miller et al. | 181/223 |
| 2008/0148928 | A1 | 6/2008 | McClellan | |
| 2012/0103176 | A1 * | 5/2012 | Latka | 89/14.4 |

* cited by examiner

*Primary Examiner* — David Warren
*Assistant Examiner* — Christina Russell
(74) *Attorney, Agent, or Firm* — Jeffrey A. Proehl; Woods, Fuller, Shultz & Smith, PC

(57) ABSTRACT

A firearm suppressor for mounting on a firearm to suppress sound emanating from the firearm when fired may comprise a housing defining an interior and a baffle insert positioned in the interior of the housing. The baffle insert may have at least two baffle wall portions dividing the interior of the housing into at least three baffle chambers, with the baffle wall portions being spaced from each other in a longitudinal direction of the insert. The baffle insert may define a central longitudinal passage for a projectile fired from the firearm to pass through the insert. The baffle insert may define a convoluted passage for combustion gases to pass through the insert, with the convoluted passage being distinct from the longitudinal passage. The convoluted passage may be in communication with the central longitudinal passage and may be defined by at least one auxiliary hole extending through the baffle wall portions.

26 Claims, 10 Drawing Sheets

FIREARM SUPPRESSOR WITH MULTIPLE GAS FLOW PATHS

BACKGROUND

Field

The present disclosure relates to firearm suppressors or silencers and more particularly pertains to a new firearm suppressor with multiple gas flow paths for providing more effective noise reduction for a firearm.

SUMMARY

The present disclosure describes a new firearm suppressor with multiple gas flow paths which may be utilized for effectively reducing noise emanating from a firearm when fired.

In one aspect, the present disclosure relates to a firearm suppressor for mounting on a firearm to suppress sound emanating from the firearm when fired. The suppressor may comprise a housing defining an interior and a baffle insert positioned in the interior of the housing. The baffle insert may have at least two baffle wall portions dividing the interior of the housing into at least three baffle chambers, with the baffle wall portions being spaced from each other in a longitudinal direction of the baffle insert. The baffle insert may define a central longitudinal passage for a projectile fired from the firearm to pass through the insert. The baffle insert may define a convoluted passage for combustion gases to pass through the insert. The convoluted passage may be distinct from the longitudinal passage and may be in communication with the central longitudinal passage. The convoluted passage may be defined by at least one auxiliary hole extending through the baffle wall portions.

In another aspect, the disclosures relates to a firearm suppressor for mounting on a firearm to suppress sound emanating from the firearm when fired. The suppressor may comprise a housing defining an interior and a baffle insert removably positioned in the interior of the housing. The baffle insert may have at least two baffle wall portions dividing the interior of the housing into at least three baffle chambers. The baffle wall portions may be spaced from each other in a longitudinal direction of the baffle insert. The baffle insert may define a central longitudinal passage for a projectile fired from the firearm to pass through the insert. Each of the baffle wall portions may have a central hole such that the central holes of the baffle wall portions collectively form the central longitudinal passage. The baffle insert may define a pair of convoluted passages for combustion gases to pass through the insert, and the convoluted passages may be distinct from the longitudinal passage at each baffle wall portion and being in communication at each baffle chamber. The convoluted passages may be defined by a pair of auxiliary holes extending through each of the baffle wall portions. At least one of the baffle wall portions may have a forward surface contoured to guide gas flow in the baffle chamber adjacent the front surface toward the auxiliary holes in the wall portion. The forward surface of the at least one baffle wall portion may have a pair of splitter protrusions configured to split a gas flow encountering the splitter protrusions.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
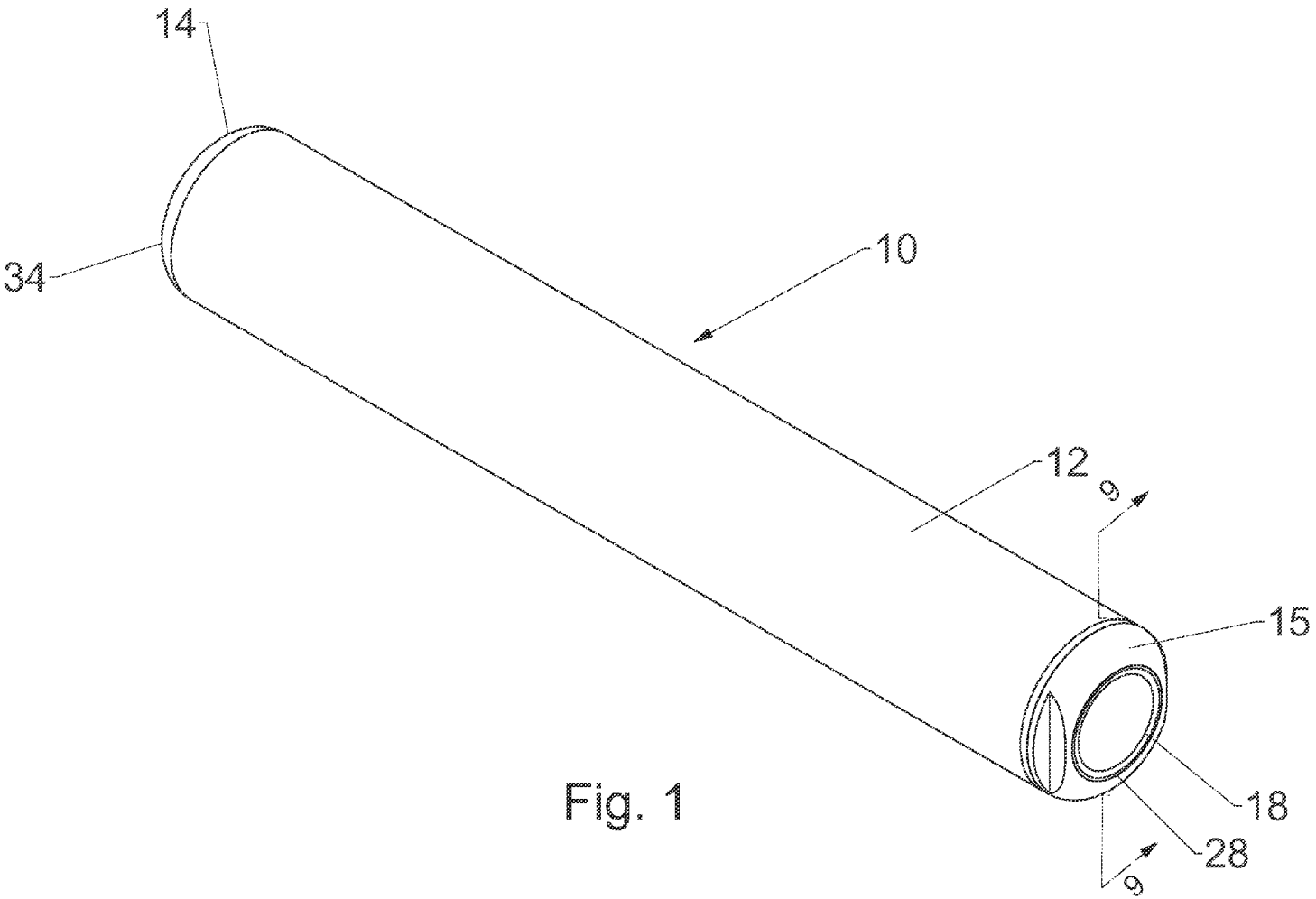
FIG. 1 is a schematic exploded perspective view of a new firearm suppressor according to the present disclosure.
Figure 2:
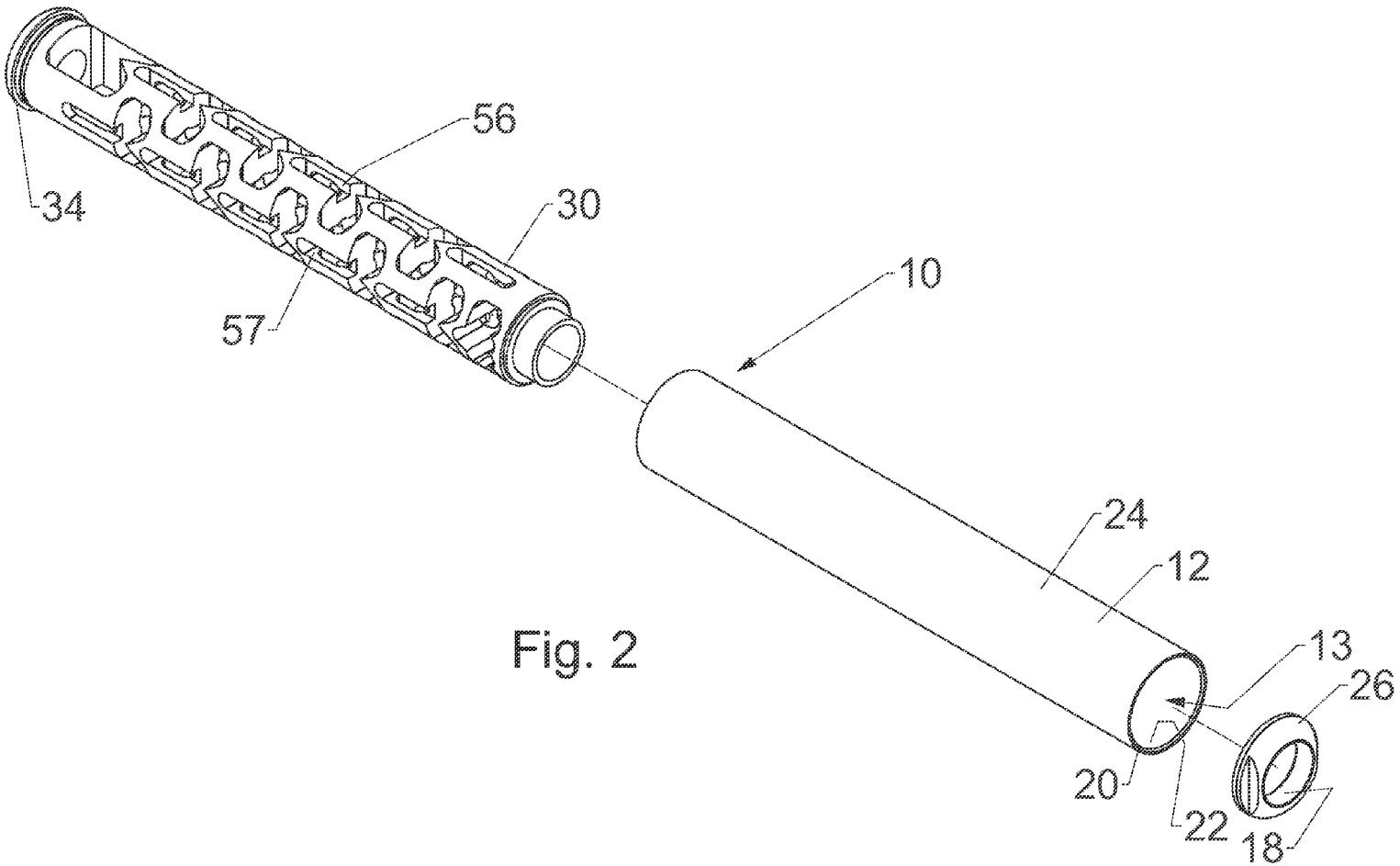
FIG. 2 is a schematic perspective view of the suppressor, according to an illustrative embodiment.
Figure 3:
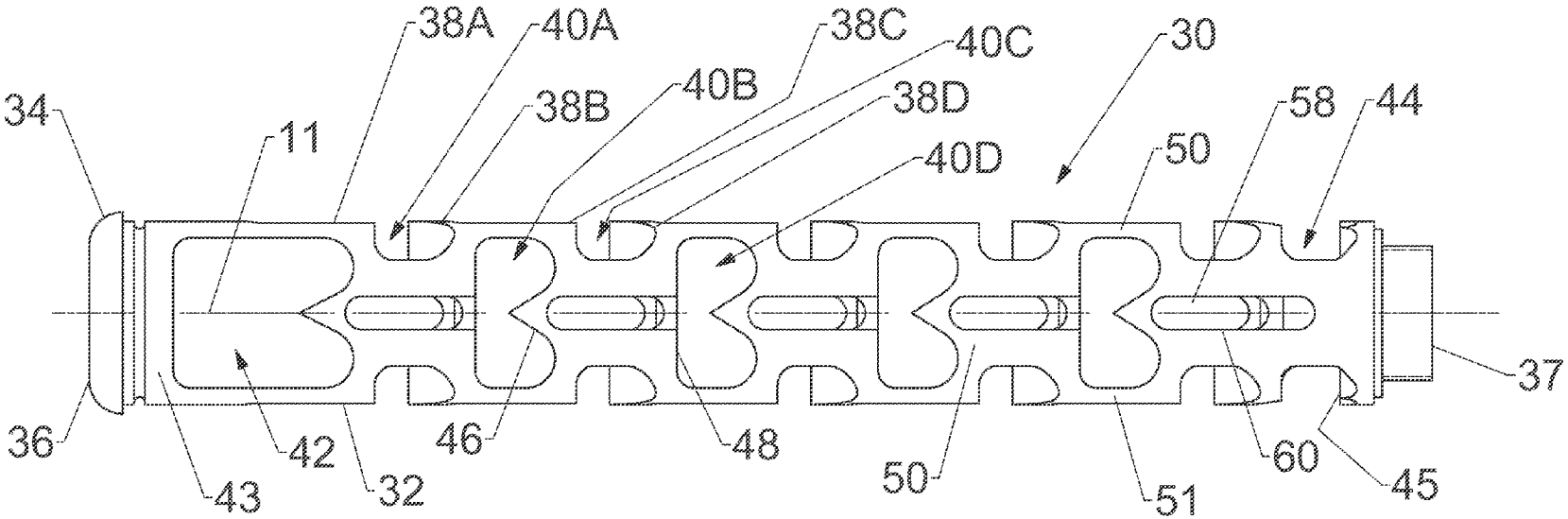
FIG. 3 is a schematic top view of the baffle insert of the suppressor, according to an illustrative embodiment.
Figure 4:
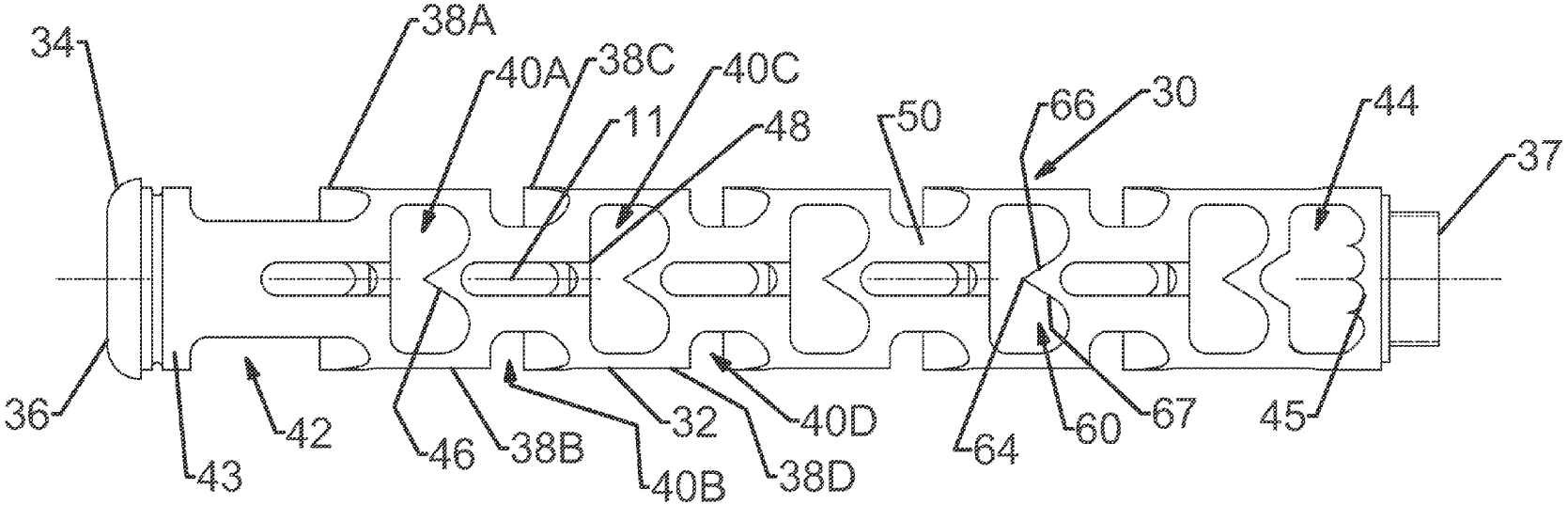
FIG. 4 is a schematic side view of the baffle insert of the suppressor, according to an illustrative embodiment.
Figure 5:
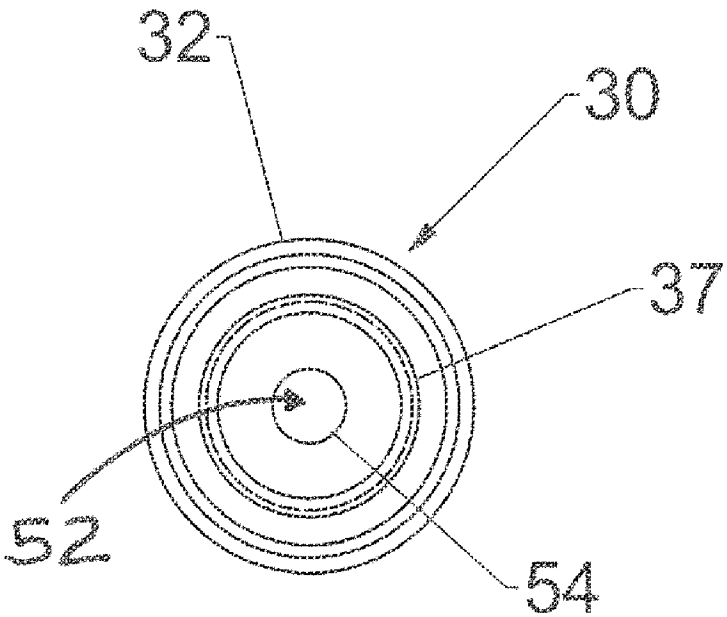
FIG. 5 is a schematic end view of the exit end of the insert of the suppressor, according to an illustrative embodiment.
Figure 6:
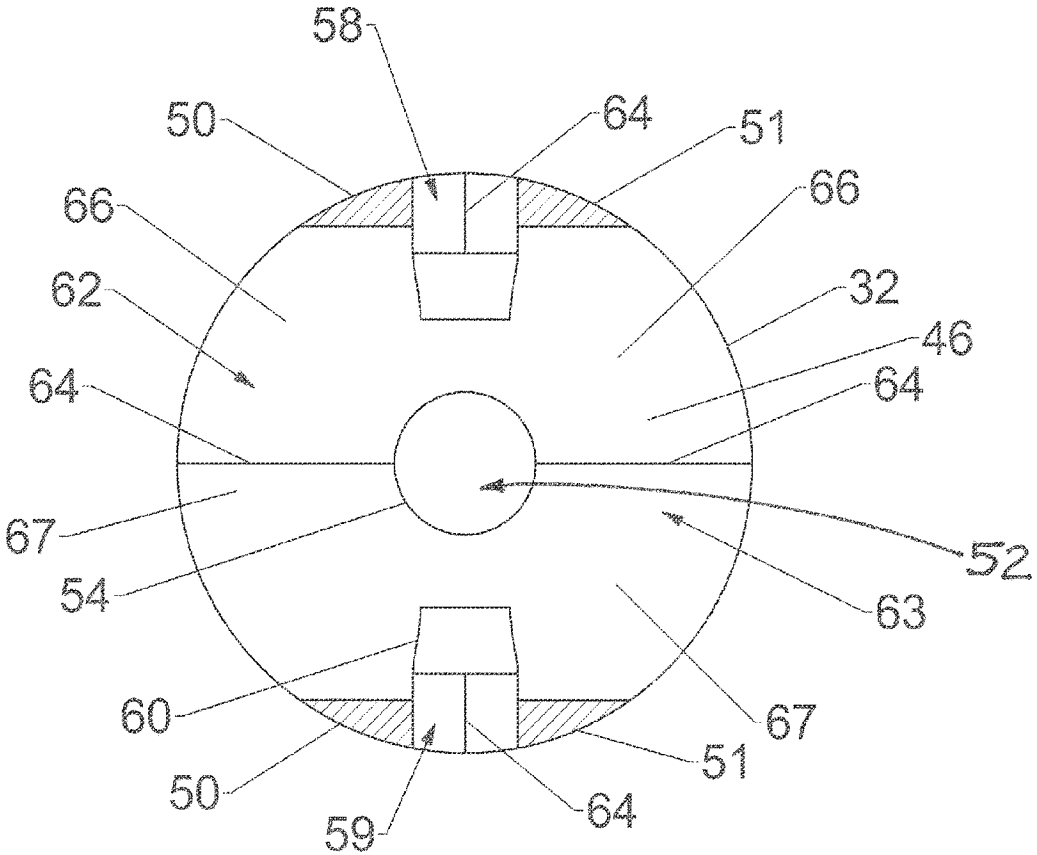
FIG. 6 is a schematic sectional view of the insert of the suppressor taken along line 6-6 of FIG. 7.
Figure 7:
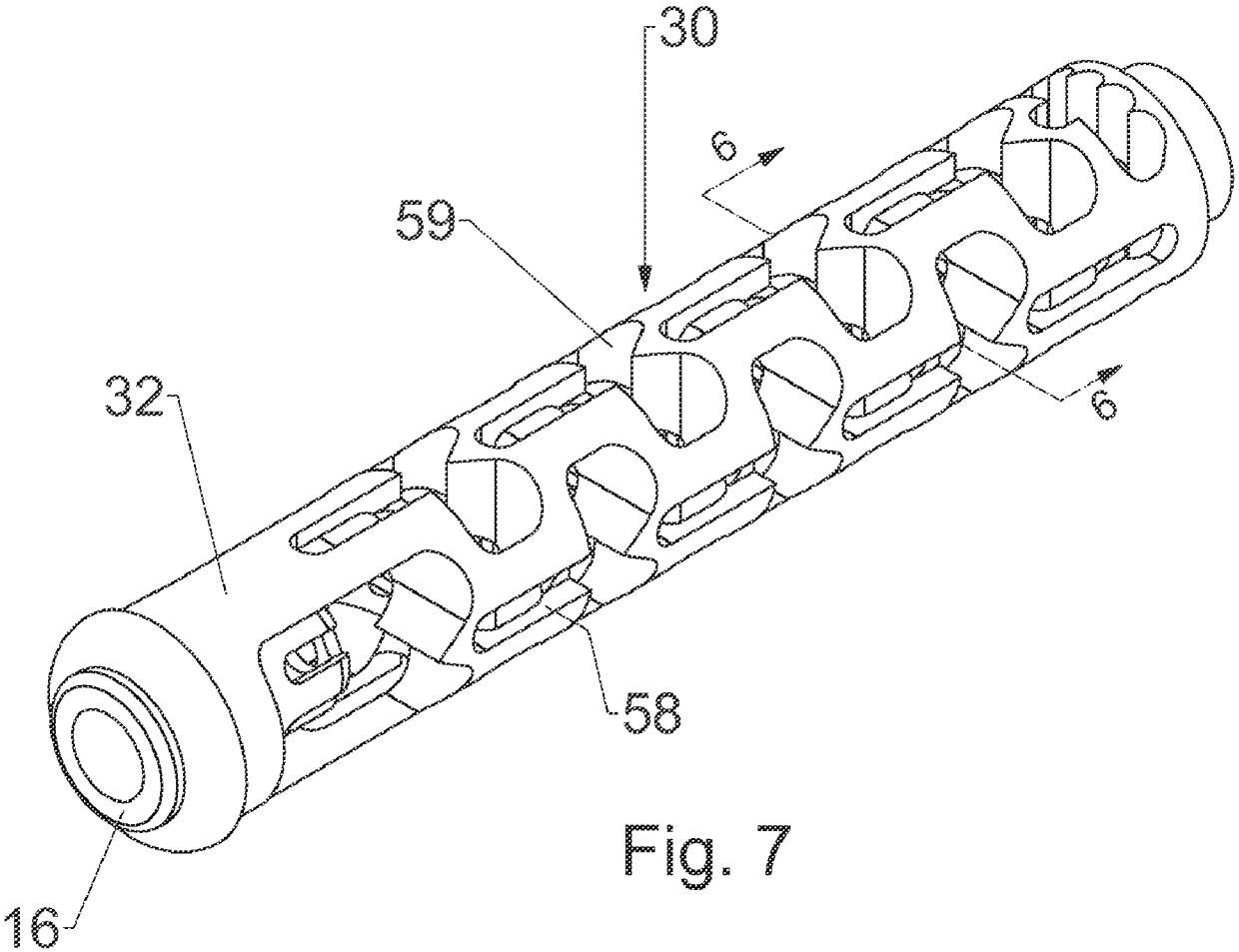
FIG. 7 is a schematic perspective view of an insert having an optional interface element for mounting between the insert and the barrel of the firearm.
Figure 8:
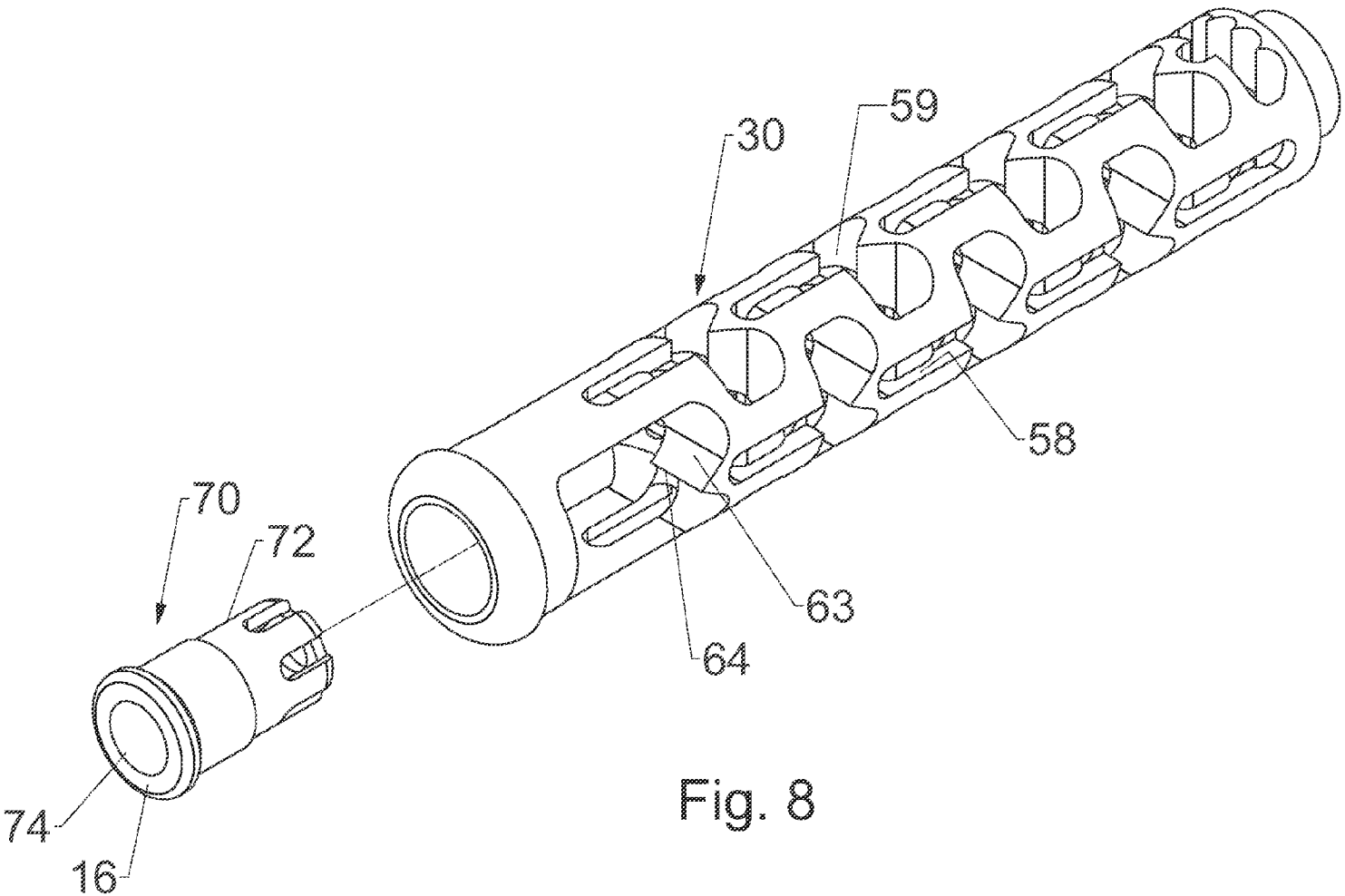
FIG. 8 is a schematic exploded perspective view of an insert having the optional interface element.
Figure 9:
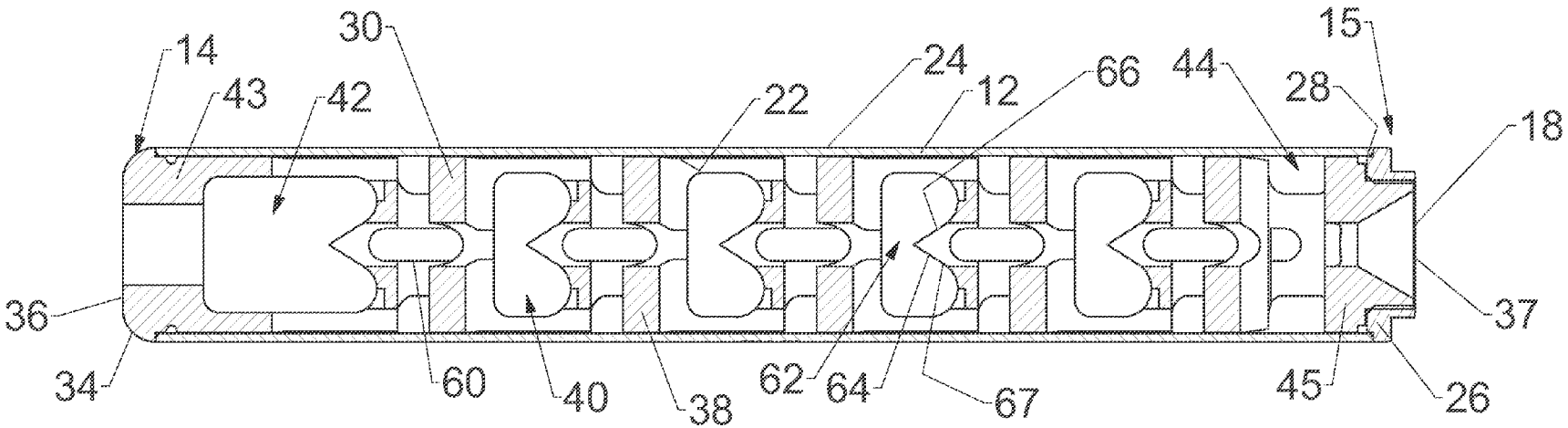
FIG. 9 is a schematic longitudinal cross sectional view of the suppressor.
Figure 10:
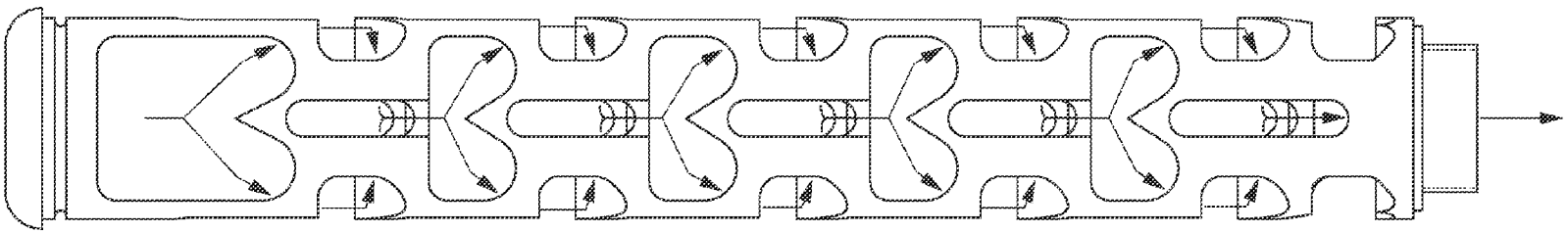
FIG. 10 is a schematic side view of the baffle insert showing a representation of the gas flow through the baffle chambers.

With reference now to the drawings, and in particular to FIGS. 1 through 10 thereof, a new firearm suppressor embodying the principles and concepts of the disclosed subject matter will be described.

In one aspect of the disclosure, a firearm suppressor 10 that may be attached to or mounted on a firearm in alignment with the bore in the end of the barrel such that a projectile fired by the firearm passes through the suppressor 10, as well as the combustion gases and sound or pressure waves created by the firing of the explosive in the chamber of the firearm. The firearm suppressor 10 is highly suitable for slowing and thus reducing the strength and intensity of the pressure waves that enter and then exit the suppressor, in part by dissipating the energy in the waves. Devices having such a function are sometimes referred to as firearm "silencers" although such devices do not completely "silence" the sound emanating from the device.

In general, the suppressor 10 includes a housing 12 and a baffle insert 30 positioned in the housing. A central longitudinal axis 11 of the suppressor 10 is substantially aligned and collinear with the bore of the barrel of the firearm when the suppressor is mounted on the firearm such that the projectile exiting the firearm travels through the suppressor along the axis 11.

The housing 12 defines an interior 13 of the suppressor 10 and has a first end 14 and a second end 15. The housing 12 may have an entry opening 16 at the first end 14 for receiving the projectile fired by the firearm, as well as the combustion gases and sound waves that follow. The housing 12 may have an exit opening 18 located at the second end 15 through which the projectile, and ultimately the combustion gases, pass.

In greater detail, illustrative embodiments of the housing 12 may include an outer wall 20, and the outer wall may have an inner surface 22 surrounding the interior 13 and which may be substantially cylindrical in shape. The outer wall 20 may have an outer surface 24 which may be substantially cylindrical in shape. The housing 12 may also include an exit wall 26 located at the second end 15 of the housing. An exit opening 28 may be formed in the exit wall 26 through which the projectile (and combustion gases and pressure waves) passes as it exits the housing 12. The exit wall 26 may be mounted on the outer wall 20 to close the second end 15 of the housing 12, and may be irremovably mounted on the second end. The mounting of the exit wall may be by any suitable means, such as, for example, the illustrated interior threads formed on an inner annular surface of the exit wall, and exterior threads formed on a circumferential surface of the baffle insert 30. In such configurations, a pair of flats may be formed on an exterior surface of the exit wall 26 to permit a tool to engage the wall for rotating the wall for mounting or dismounting from the wall.

The baffle insert 30 positioned in the interior of the housing may be removably mounted therein, or more permanently mounted such that it is not removable after initial assembly. The baffle insert 30 is inserted in the interior 13 of the housing, and may be monolithic in that the insert is formed of a single piece of material which has been machined to form the various features described herein. Optionally, but less preferably, the baffle may be formed of more than one piece of material.

The baffle insert 30 may be inserted into the interior 13 of the housing through the first end 14 of the housing. The baffle insert 30 may have an outer major surface 32 which may be substantially cylindrical to inside of and substantially snugly against the inner surface 22 of the outer wall 20 of the housing. The baffle insert 30 may have a circumferential lip 34 formed thereon that extends outwardly and protrudes from the outer major surface 32 of the baffle to limit the insertion of the baffle insert into the interior. The baffle insert 30 has an entrance end 36 and an exit end 37, with the circumferential lip being located toward the entrance end and the exit end being inserted first into the interior of the housing.

The baffle insert 30 has at least two baffle wall portions 38 that divide the interior 13 of the housing 12 into at least two baffle chambers 40. The baffle wall portions 38 of the baffle insert 30 are spaced from each other in a longitudinal direction of the baffle insert to form the baffle chambers in the intervening spaces. The baffle wall portions, and baffle chambers, are arrayed in the longitudinal direction of the baffle insert. Baffle chambers 40*a*, 40*b*, 40*c*, 40*d*, and so forth are separated from each other by baffle wall portions 38*a*, 38*b*, 38*c*, 38*d* and so forth. In the illustrative embodiments, an initial baffle chamber 42 is configured somewhat differently than most of the other baffle chambers 40, and a final baffle chamber 44 is also configured somewhat differently than most of the other baffle chambers, as the initial wall portion 43 (adjacent the initial baffle chamber 42) is not configured like the following wall portions 38, and the final wall portion 45 (adjacent the final baffle chamber 44) is also not configured like the preceding wall portions 38. Each of the baffle wall portions 38 has a forward surface 46 and a rearward surface 48, with the forward surface being oriented toward the first end 14 of the suppressor, and the rearward surface being oriented toward the second end of the suppressor such that the combustion gases exiting the firearm first encounter the forward surface of each baffle wall portion before encountering the rearward surface.

The baffle insert 30 may further include at least one connector portion 50 that extends between and connects adjacent baffle wall portions 38 together, and in the illustrative baffle insert 30 a pair of connector portions 50, 51 connect adjacent wall portions 38. The pair of connector portions 50, 51 may be located at substantially circumferentially opposite locations on the baffle insert 30.

The baffle insert 30 defines a central longitudinal passage 52 for a projectile to pass through the insert 30 along the central longitudinal axis 11. The central longitudinal passage 52 is formed or defined by a central hole 54 formed in each of the baffle wall portions 38. The central holes 54 are axially aligned along the axis 11 such that the central longitudinal passage 52 extends from the entrance end 36 to the exit end 37 of the insert.

In addition to the central longitudinal passage 52 along which the projectile passes through the insert 30, at least one convoluted passage may be defined by the insert 30 for the passage of combustion gases through the insert and the interior 13 of the housing. The convoluted passage 56 is distinct from the longitudinal passage 52, but may not be isolated from the passage 52, and there may be communication of gasses between the longitudinal passage 52 and the convoluted passage 54. Additionally, a pair of the convoluted passages 56, 57 may be defined by the array of the baffle wall portions 38

The convoluted passage 54 (or passages) may being defined by at least one auxiliary hole 58 formed in each of the baffle wall portions. The auxiliary hole 58 may have the form of a slot 60 and may be at least partially formed by the connector portion 50, as well as the inner surface 22 of the outer wall of the housing. The slot 60 may extend in a longitudinal direction of the baffle insert and may divide the connector portion 50 into two sections. The slot 60 may be located along the outer major surface 32 of the insert 30. In embodiments having a pair of convoluted passages 56, 57, a pair of the auxiliary holes 58, 59 is formed in the baffle wall portion to form the convoluted passages. The pair of auxiliary holes 58, 59 (and the corresponding slots) may be positioned at opposite locations on the baffle wall portion.

One significant aspect of the disclosure is that each of the baffle wall portions 38 may be rotated about the central longitudinal axis 11 of the suppressor with respect to the preceding wall portion 38 in the array of wall portions, and also with respect to the succeeding wall portions. Illustratively, in some of the most preferred embodiments of the suppressor, each successive wall portion is rotated approximately 90 degrees about the axis with respect to the preceding wall portion, and also with respect to the succeeding wall portions in the array.

As a result, the contouring of the forward surface 46 of each succeeding wall portion is oriented differently than the contouring of the forward surface of the preceding wall portion. Thus, the locations of the auxiliary holes 58, 59 (and associated slots) in a first baffle wall portion (38*a*) may be circumferentially offset from the locations of the auxiliary holes in a second, adjacent baffle wall portion (38*b*).

Another significant aspect of the suppressor 10 is the contouring of the forward surface of the wall portions 38, which will now be described. The forward surface 46 may have at least one splitter protrusion 62 that is configured to split the flow of combustion gases that encounter the region of the forward surface having the splitter protrusion formed thereon. The splitter protrusion 62 may include a ridge 64 that is raised from the rest of the forward surface 46 and protrudes in the direction of the entrance end 36 of the baffle insert. The ridge 64 may extend radially outwardly from a central region of the forward surface of the baffle wall portion, and may extend generally along a line radiating outwardly from the central hole 54. The ridge 64 may divide the gas flow into two flows going in opposite and laterally outward directions.

The splitter protrusion 62 may include a pair of guide regions 66, 67 located on either side of the ridge 64. The guide regions may be contoured and curved to facilitate the flow of the gasses encountering the splitter protrusion to turn the flow direction approximately 90 degrees so that the gasses are diverted to flow in a direction that is perpendicular to the longitudinal direction or axis of the insert 30. The gas flow then encounters the slot 60 and auxiliary hole 58 that permits the gases to move through the baffle wall portion into the succeeding baffle chamber.

In some preferred embodiments of the insert 30, the splitter protrusion 62 of a baffle wall portion is positioned in alignment with one of the auxiliary holes (and associated slot) of an adjacent baffle wall portion in the array of baffle wall portions. As shown in the Figures, this relationship may be the result of the rotated orientation of succeeding wall portions with respect to preceding wall portions in the array of wall portions. The gas flow passing through the slot and auxiliary hole of one wall portion thus is directed toward the splitter protrusion of the succeeding wall portion. The contouring of the forward surface tends to direct the gas flow toward the slot and auxiliary hole of that wall portion, and the gas traveling through that hole thus encounters the splitter protrusion of the next wall portion.

In the preferred embodiments, the forward surface of a baffle wall portion has a pair of the splitter protrusions 62, 63. Further, the ridges 64 of the pair of splitter protrusions may be diametrically aligned on the baffle wall portion. The two splitter protrusions, and the contouring of the guide regions, of the wall portion may produce gas flows that collide at each of the slots and auxiliary holes of the respective wall portion. The collision of the gas flows may serve to dissipate energy in the gas flows as well as help to turn the flows another 90 degrees to flow through the slot and auxiliary hole (see FIG. 10). Thus, the longitudinal gas flows from the auxiliary holes of a baffle wall portion into a baffle chamber encounter the splitter protrusions of the forward surface of the adjacent baffle wall portion and are split into four flows (two at each splitter protrusion) and turned approximately 90 degrees to flow laterally toward a gas flow from the other splitter protrusion. Proximate to each of the slots, the gas flows collide and turn to flow through the slot and auxiliary hole into the next baffle chamber In some embodiments, an interface device 70 may be mounted on the suppressor 10 to facilitate the mounting of the suppressor on the firearm, and may be used to provide a thermal buffer between the barrel of the firearm (as well as the combustion gases exiting the bore) and the baffle insert 30, so that the baffle insert is not exposed to the level of heat that is present at the end of the barrel of the firearm. With this partial thermal buffer, the material of the baffle insert may be made of a less thermally resistant material (such as, for example, aluminum) than when the baffle insert 30 is mounted directly to the end of the barrel of the firearm, and the interface device 70 may be formed of a more thermally resistant material, such as stainless steel. Without the interface device, the entire baffle insert may need to be formed of a thermally resistant material such as stainless steel. A portion of the exterior surface 72 of the interface device 70 may be threaded to engage interior threads formed on the baffle insert at the entrance end 36 of the baffle insert. The interface device may also have a bore 74 that aligns with the central longitudinal passage 52 of the baffle insert as well as the bore of the barrel when mounted on the firearm. The bore 74 may be interiorly threaded to accept the threaded end of the firearm barrel.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A firearm suppressor for mounting on a firearm to suppress sound emanating from the firearm when fired, the suppressor comprising:

a housing defining an interior; and a baffle insert positioned in the interior of the housing;

wherein the baffle insert has at least two baffle wall portions dividing the interior of the housing into at least three baffle chambers, the baffle wall portions being spaced from each other in a longitudinal direction of the baffle insert;

wherein the baffle insert defines a central longitudinal passage for a projectile fired from the firearm to pass through the insert;

wherein the baffle insert defines a convoluted passage for combustion gases to pass through the insert, the convoluted passage being distinct from the longitudinal passage, the convoluted passage being in communication with the central longitudinal passage, the convoluted passage being defined by at least one auxiliary hole extending through the baffle wall portions;

wherein a position of the at least one auxiliary hole in a first one of the baffle wall portions is rotated about the central longitudinal passage approximately 90 degrees from a position of the at least one auxiliary hole in an adjacent second one of the baffle wall portions.

2. The suppressor of claim 1 wherein each of the baffle wall portions has a pair of the auxiliary holes in addition to a central longitudinal hole formed in the baffle wall portion to form a part of the central longitudinal passage.

3. The suppressor of claim 2 wherein the pair of auxiliary holes are positioned at opposite locations on the baffle wall portion.

4. The suppressor of claim 2 wherein the pair of auxiliary holes are positioned at a circumference of the baffle wall portion.

5. The suppressor of claim 2 wherein locations of the pair of auxiliary holes in a first one of the baffle wall portions are circumferentially offset from locations of the auxiliary holes in a second, adjacent one of the baffle wall portions.

6. The suppressor of claim 1 wherein at least one of the baffle wall portions has a forward surface and a rearward surface, the forward surface being contoured to guide gas flow in the baffle chamber adjacent the forward surface toward the at least one auxiliary hole.

7. The suppressor of claim 6 wherein the forward surface of the at least one baffle wall portion has at least one splitter protrusion extending toward the auxiliary hole in an adjacent one of the baffle wall portions to split gas flow from said auxiliary hole encountering the splitter protrusion.

8. The suppressor of claim 7 wherein the at least one splitter protrusion including a ridge protruding in a forward direction from the front surface of the baffle wall portion.

9. The suppressor of claim 8 wherein the ridge extends along a line radiating outwardly from a central region of the front surface of the baffle wall portion.

10. The suppressor of claim 8 wherein the at least one splitter protrusion including a pair of guide regions located on either side of the ridge, each of the guide regions being contoured to guide gas flow toward one of the at least one auxiliary holes in the baffle wall portion.

11. The suppressor of claim 7 wherein the forward surface of at least one of the baffle wall portions has a pair of the splitter protrusions, and each splitter protrusion includes a ridge, each of the ridges of the pair of splitter protrusions being diametrically aligned.

12. The suppressor of claim 7 wherein the at least one splitter protrusion of one baffle wall portion is positioned in alignment with one of the auxiliary holes of an adjacent baffle wall portion along a longitudinal axis of the baffle insert.

13. The suppressor of claim 1 wherein the central longitudinal passage being formed by a central hole in each of the baffle wall portions of the insert, the central holes of the baffle wall portions being axially aligned and being separate from the at least one auxiliary hole in the baffle wall portion.

14. The suppressor of claim 1 wherein the baffle insert includes at least one connector portion extending between and connecting adjacent baffle wall portions together.

15. The suppressor of claim 14 wherein the baffle insert includes a pair of the connector portions, the pair of connector portions being located at substantially circumferentially opposite locations on the baffle insert.

16. The suppressor of claim 14 wherein the at least one auxiliary hole is at least partially formed by the at least one connector portion.

17. The suppressor of claim 14 wherein the at least one auxiliary hole comprises a slot formed in the at least one connector portion, the slot extending in a longitudinal direction of the baffle insert.

18. The suppressor of claim 1 wherein the baffles insert is monolithic.

19. The suppressor of claim 1 wherein each of the baffle wall portions has a pair of the auxiliary holes in addition to a central longitudinal hole formed in the baffle wall portion to form a part of the central longitudinal passage, the pair of auxiliary holes being positioned at opposite locations on the baffle wall portion, the pair of auxiliary holes being positioned at a circumference of the baffle wall portion;

wherein locations of the pair of auxiliary holes in a first one of the baffle wall portions are circumferentially offset from locations of the auxiliary holes in a second, adjacent one of the baffle wall portions;

wherein at least one of the baffle wall portions has a forward surface and a rearward surface, the forward surface being contoured to guide gas flow in the baffle chamber adjacent the front surface toward the at least one auxiliary hole, the forward surface of the at least one baffle wall portion having a pair of splitter protrusions configured to split a gas flow encountering the splitter protrusions, the splitter protrusions including a ridge protruding from the front surface of the baffle wall portion, the ridge extending radially outwardly from a central region of the front surface of the baffle wall portion, each splitter protrusion including a pair of guide regions located on either side of the ridge, each of the guide regions being contoured to guide gas flow toward one of the pair of auxiliary holes in the baffle wall portion, the ridges of the pair of splitter protrusions being diametrically aligned;

wherein the at least one splitter protrusion of one baffle wall portion is positioned in alignment with one of the auxiliary holes of an adjacent baffle wall portion along a longitudinal axis of the baffle insert;

wherein the central longitudinal passage is formed by a central hole in each of the baffle wall portions of the insert, the central holes of the baffle wall portions being axially aligned and being separate from the at least one auxiliary hole in the baffle wall portion;

wherein the baffle insert includes a pair of connector portion extending between and connecting adjacent baffle wall portions together, the pair of connector portions being located at substantially circumferentially opposite locations on the baffle insert;

wherein at least one of the auxiliary holes is at least partially formed by one of the connector portions, the auxiliary hole comprising a slot formed in the at least one connector portion, the slot extending in a longitudinal direction of the baffle insert; and wherein the baffle insert is monolithic.

20. The suppressor of claim 1 wherein the position of the at least one auxiliary hole in each of the baffle wall portions with respect to the central longitudinal axis alternates from baffle wall portion to baffle wall portion of the baffle insert.

21. The suppressor of claim 1 wherein two of the baffle wall portions are positioned adjacent to each other and each have a forward surface shape substantially identical to each other, and an orientation of the forward surface shape of a first one of the baffle wall portions is rotated about the central longitudinal passage with respect to an orientation of the forward surface shape of a second one of the baffle wall portions.

22. The suppressor of claim 1 wherein the insert has a central longitudinal axis, and the baffle wall portions of the insert have at least two planes of symmetry that include the central longitudinal axis.

23. A firearm suppressor for mounting on a firearm to suppress sound emanating from the firearm when fired, the suppressor comprising:

a housing defining an interior; and a baffle insert removably positioned in the interior of the housing;

wherein the baffle insert has at least two baffle wall portions dividing the interior of the housing into at least three baffle chambers, the baffle wall portions being spaced from each other in a longitudinal direction of the baffle insert;

wherein the baffle insert defines a central longitudinal passage for a projectile fired from the firearm to pass through the insert, each of the baffle wall portions having a central hole such that the central holes of the baffle wall portions collectively form the central longitudinal passage;

wherein the baffle insert defines a pair of convoluted passages for combustion gases to pass through the insert, the convoluted passages being distinct from the longitudinal passage at each baffle wall portion and being in communication at each baffle chamber, the convoluted passages being defined by a pair of auxiliary holes extending through each of the baffle wall portions;

wherein at least one of the baffle wall portions has a forward surface contoured to guide gas flow in the baffle chamber adjacent the front surface toward the auxiliary holes in the wall portion along a path that does not cross the central longitudinal passage.

24. The suppressor of claim 23 wherein the forward surface of the at least one baffle wall portion has at least one splitter protrusion extending forwardly toward one of the auxiliary holes in an adjacent baffle wall portion to split a gas flowing from the auxiliary hole of the adjacent baffle wall portion.

25. The suppressor of claim 24 wherein the forward surface of the baffle wall portion has a guide region extending from the splitter protrusion of the baffle wall portion to at least one of the auxiliary hole of the baffle wall portion.

26. A firearm suppressor for mounting on a firearm to suppress sound emanating from the firearm when fired, the suppressor comprising:

a housing defining an interior; and a baffle insert positioned in the interior of the housing;

wherein the baffle insert has at least two baffle wall portions dividing the interior of the housing into at least three baffle chambers, the baffle wall portions being spaced from each other in a longitudinal direction of the baffle insert;

wherein the baffle insert defines a central longitudinal passage for a projectile fired from the firearm to pass through the insert;

wherein the baffle insert defines a convoluted passage for combustion gases to pass through the insert, the convoluted passage being distinct from the longitudinal passage, the convoluted passage being in communication with the central longitudinal passage, the convoluted passage being defined by at least one auxiliary hole extending through the baffle wall portions;

wherein the orientation of a first one of the baffle wall portions is rotated approximately 90 degrees about the central longitudinal passage with respect to the orientation of a second one of the baffle wall portions.

* * * * *